US007004597B2

(12) United States Patent
Kukuk

(10) Patent No.: US 7,004,597 B2
(45) Date of Patent: Feb. 28, 2006

(54) MULTI-FUNCTIONAL LAW ENFORCEMENT TOOL

(75) Inventor: Craig Allen Kukuk, Boise, ID (US)

(73) Assignee: Craig Kukuk, Boise, ID (US)

( * ) Notice: Subject to any disclaimer, the term of this patent is extended or adjusted under 35 U.S.C. 154(b) by 291 days.

(21) Appl. No.: 10/139,582

(22) Filed: May 3, 2002

(65) Prior Publication Data

US 2002/0163799 A1 Nov. 7, 2002

Related U.S. Application Data

(63) Continuation-in-part of application No. 09/699,846, filed on Oct. 29, 2000, now Pat. No. 6,499,855.

(51) Int. Cl.
*A45B 3/02* (2006.01)

(52) U.S. Cl. ..... 362/102; 362/96; 362/109; 362/110

(58) Field of Classification Search ..... 362/96, 362/102, 109, 110; 70/16; 463/47.3, 47.4, 463/47.7

See application file for complete search history.

(56) References Cited

U.S. PATENT DOCUMENTS 3,737,649 A * 6/1973 Nelson et al. ..... 362/102
3,776,429 A * 12/1973 DeLucia ..... 222/162
4,186,851 A * 2/1980 Cantor ..... 222/113
4,223,804 A * 9/1980 Morris et al. ..... 222/3
4,842,277 A * 6/1989 LaCroic ..... 273/84
5,086,377 A * 2/1992 Roberts ..... 362/102
5,287,255 A * 2/1994 Strodtman ..... 362/102
5,405,134 A * 4/1995 Wolfram ..... 463/47.4
5,446,985 A * 9/1995 Chen ..... 42/1.08
5,683,168 A * 11/1997 Teig et al. ..... 362/96
5,795,054 A 8/1998 Booty, Jr.
D401,374 S * 11/1998 Lum ..... D26/38
6,139,165 A * 10/2000 Crowe ..... 362/102
6,199,997 B1 * 3/2001 Outsen et al. ..... 362/109
6,386,726 B1 * 5/2002 Macierowski et al. ..... 362/102
6,499,855 B1 * 12/2002 Kukuk ..... 362/102
6,615,622 B1 * 9/2003 MacAleese et al. ..... 70/16

* cited by examiner

*Primary Examiner*—Sandra O'Shea
*Assistant Examiner*—Anabel Ton

(57) ABSTRACT

The invention is a multifunctional law enforcement tool, which preferably includes several of the tools needed by law enforcement and security personnel. In one embodiment the multifunctional tool comprising an extendable baton, flashlight, stun gun, glass breaker, and deterrent spray canister and I.D. holder within an orthogonal handle.

In the second embodiment the extendable baton and full length glass breaker are removed and replaced with a rubber compression unit and miniature glass breaker. For a more compact and more easily carried unit.

In the third embodiment a disposable deterrent spray canister and canister top make for a quicker change of new and used canister.

6 Claims, 15 Drawing Sheets

MULTI-FUNCTIONAL LAW ENFORCEMENT TOOL

This application is a continuation in part of Utility Patent Ser. No. 09/699,846 entitled Combination Police Baton filed Oct. 29, 2000 now U.S. Pat. No. 6,499,855 herein incorporated by reference.

BACKGROUND OF THE INVENTION

1. Field of the Invention

This invention relates generally to law enforcement and security personnel. More specifically, this invention relates to different combinations of a flashlight, spray deterrent, glass breaker and stun gun with an extendable baton and an orthogonal handle.

2. Related Art

U.S. Pat. No. 5,287,255 (Stordtman) discloses combination flashlight-baton.

U.S. Pat. No. 5,405,134 (Wolfram) discloses combination gas ejecting handle, attachment for baton and flashlight.

U.S. Pat. No. 3,737,649 (Nelson et al.) discloses a combination baton-flashlight.

U.S. Pat. No. 3,776,429 (Delucia) discloses a combination flashlight and propellant discharge device.

U.S. Pat. No. 4,186,851 (Cantor), and U.S. Pat. No. 4,223,804 (Morris et al.) disclose a pepper spray canister in a flashlight. U.S. Pat. No. 5,446,985 (Chen), U.S. Pat. No. 5,683,168 (Teig et al.), and U.S. Pat. No. 5,795,054 (Booty, Jr.) also disclose a pepper spray canister in a flashlight.

U.S. Pat. No. 5,086,377 (Roberts) discloses a combination baton and propellant discharge device.

U.S. Pat. No. 401,374 (Lum) discloses ornamental features for a combination flashlight and propellant discharge device in a police baton with a bolt-on orthogonal handle.

In addition, Armament Systems and Procedures, Inc. (A.S.P.) of Appleton, Wis., U.S.A. offers a Tac-Lites* combination flashlight and extendable baton.

Still, there is a need for a compact but effective multifunctional law enforcement tool with the special features of a flashlight, pepper spray, stun gun, glass breaker and extendable baton. This invention will address the need of law enforcement and security personnel.

SUMMARY OF THE INVENTION

The invention is a multifunctional law enforcement tool that may serve an officer's need to have various features and options quickly at hand, while keeping the officer's gun hand free. In one embodiment, the invention comprising a flashlight, spray deterrent, stun gun, glass breakers, with an extendable baton and orthogonal handle. In another embodiment, the extendible baton and full length glass breaker are replaced with a rubber compression unit and miniature glass breaker for a more concealable unit.

In a third embodiment no functional changes were made from the first embodiment, however a more quickly changed deterrent spray canister and housing were added.

The invented multifunctional law enforcement tool allows several important devices to be easily at hand for law enforcement and security personnel, in a single unit. By having all the tools combined into one unit this leaves the users gun hand always free. Also, the invented combination baton places both defensive and offensive tools together in the user's hand, along with a flashlight. The user keeps a light, deterrent spray, stun gun and a baton for offensive and defensive purposes. Having all the commonly used tools ready immediately, greatly increases his options when dealing with the uncertainties of a suspects behavior. The officer may approach a suspect with the invented baton in one hand and his other hand ready at his gun, and may respond to a suspect's behavior as appropriate. The user need not whisk out a deterrent spray container, baton or stun gun, if he senses they may be needed. These actions can be threatening and confrontational and can escalate the situation. Instead, he can hold and use the multifunctional law enforcement tool as a flashlight, which is a non-threatening action, while having the other defensive and offensive tools ready for use. Thus, the invented combination allows the user to be more in control of the situation, and ready for many turn of events.

Another object of the invented multifunctional law enforcement tool is to eliminate the need for several different objects (spray, baton, stun gun, flashlight and glass breaker) to be clipped separately onto an officer's belt. This eliminates the "clutter" of the separate objects, and reduces total weight because the invention may weigh significantly less, by about 2 or 3 pounds, than the total of the separate objects. Also, for a female officer with a small waist, it is difficult to position the separate objects around her belt.

Another possible use of the invented multifunctional law enforcement tool is with airline security. These non-lethal options will help detain or incapacitate confrontational passengers where more lethal alternatives would be less appropriate.

DESCRIPTION OF THE PREFERRED EMBODIMENTS

Referring to the figures, these are depicted several, but not all, embodiments of the present invention, which is a multifunctional law enforcement tool. In the following description of the preferred embodiment, the term "Distal" refers to the end of the baton from which the extendible baton extends and that includes the glass breaking tip or the threaded end of the handle unit when the baton is not present. The "Proximal" refers to the end containing the flashlight and stun gun probes. Because of the typical use of the invented baton with the flashlight pointing "forward" from the user, the flashlight end is also referred to as the "forward" direction, and the glass breaker end is also referred to as the "rearward" direction.

Figure 1:
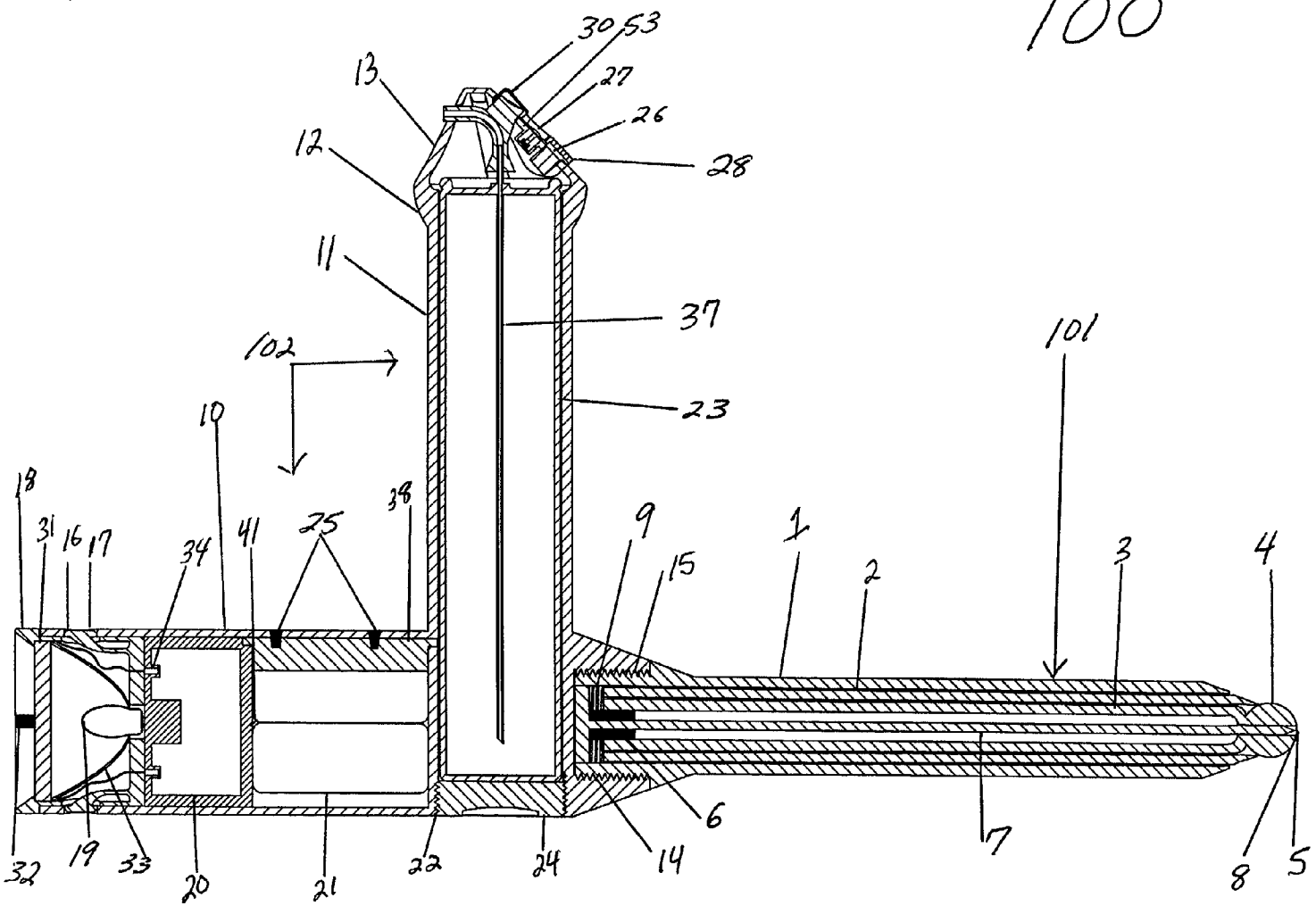
FIG. 1 Depicts a cross section view of invention wherein the baton is collapsed.
Figure 2:
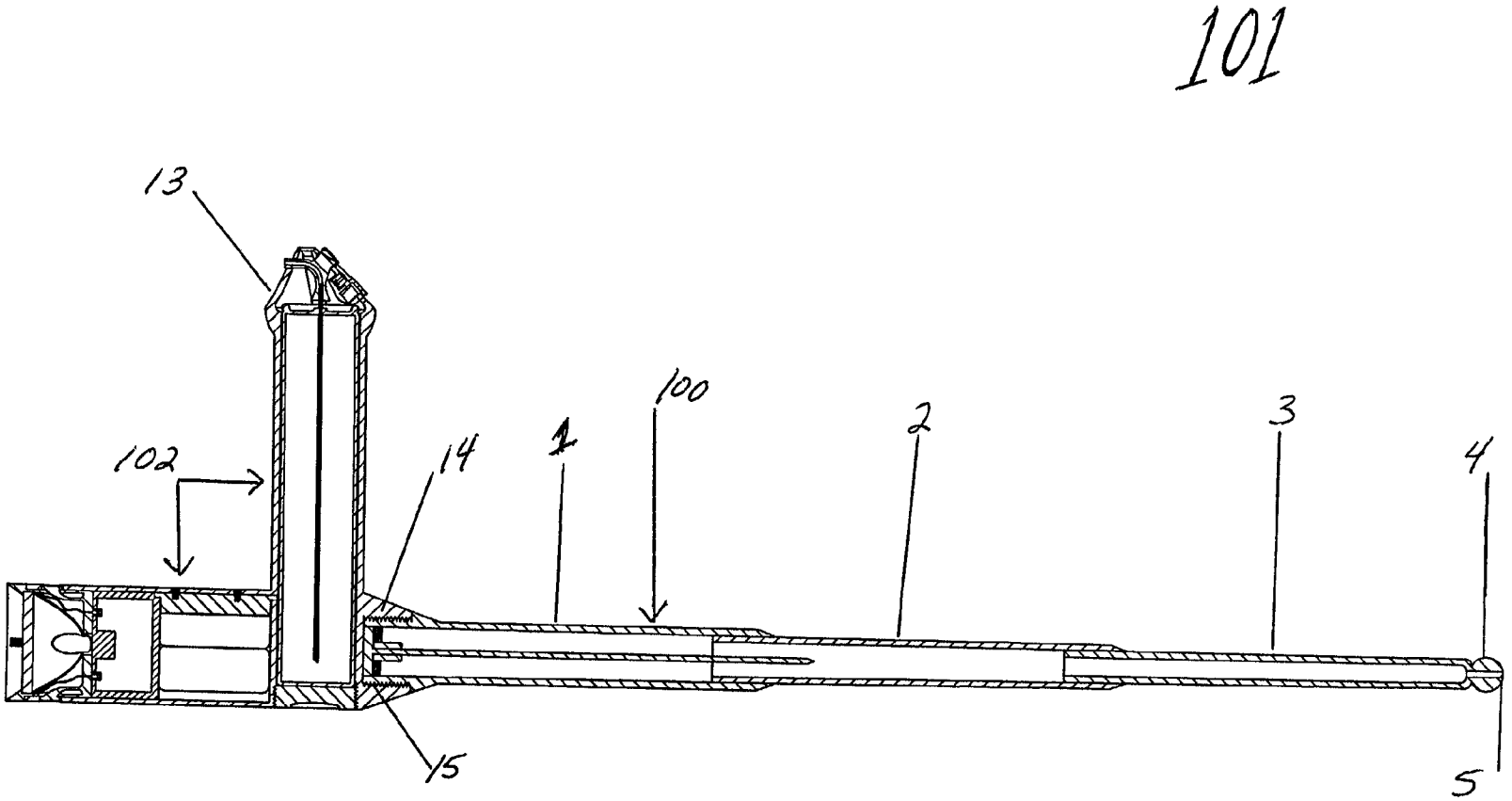
FIG. 2 Depicts the embodiment of FIG. 1 wherein the baton is extended.
Figure 11:
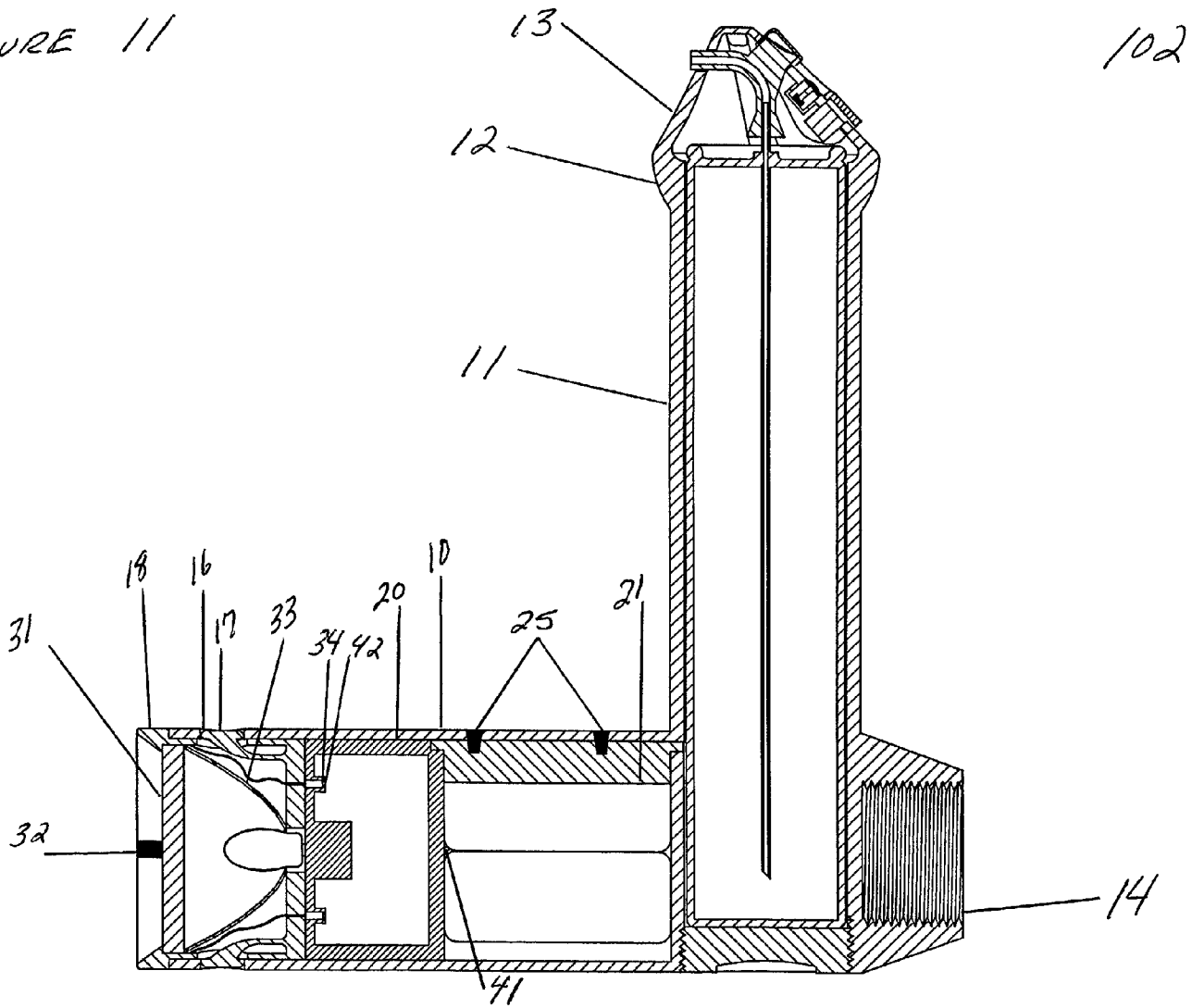
FIG. 11 Depicts cross section view of FIG. 1 without extendable baton and full length glass breaker.

FIGS. 1 and 2 depict a first embodiment of the invented Multifunctional Law Enforcement Tool 100, which comprises a Telescoping Baton 101 and a Handle Unit 102 (FIG. 11). According to these figures, FIG. 2 of the preferred embodiment comprises three Telescoping Tubular Members. These Telescoping Tubular Members are extended preferably with a quick wave of the baton, an action which might be called "whipping out" the baton. Centrifugal force extends the baton wherein frictional engagement maintains the batons extended state. The Telescoping Baton 101 of FIG. 2's innermost Tubular Member 3 has a Small Mass 4 with a Hole 5 at its distal end. The Small Mass 4 is used to break glass in its extended position combined with centrifugal force generated by the user.

Figure 5:
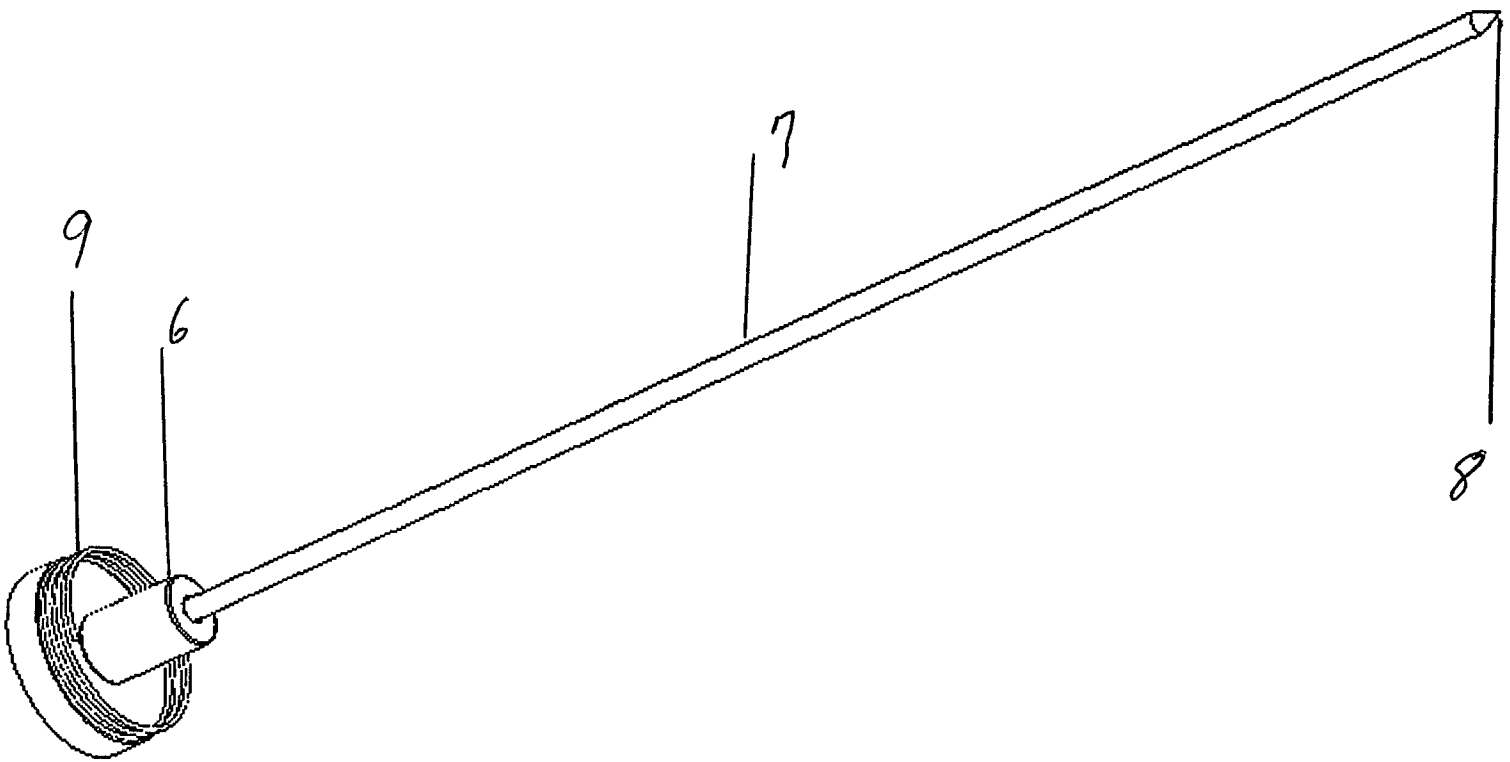
FIG. 5 Depicts a perspective view of glass breaking unit with retention magnet and return spring.

Telescoping Tubular Member 1 is interchangeably connected (discussed below) to Handle Unit 102 of FIG. 1 at the threaded end of the Tubular Member 1. When Multifunctional Law Enforcement Tool 100 of FIG. 1 is in its compact position Tubular Member 3's position is secured by a Magnetic Retention Clip 6 thus holding baton from accidental extension (FIG. 5). Retention Clip 6 is attached to Compact Glass Breaker Body 7. The Compact Glass Breaker is another preferred feature of FIG. 1. The Compact Glass Breaker is implemented by striking the Small Mass 4 and Hole 5 against glass. The Compact Glass Breaker comprising a Pointed Tip 8, Magnetic Retention Clip 6, Wave Spring 9 and a Glass Breaker Body 7. At the threaded end of Tubular Member 1 of FIG. 1 is a Wave Spring 9 which permits a small amount of relative travel inward of Tubular Member 3 thus allowing Pointed Tip 8 to protrude beyond Hole 5 when struck against glass, (FIG. 8) thus breaking the glass. Following glass breakage the compressed Tubular Member 3 is returned to its original compact position by Wave Spring 9 wherein magnetic retention clip holds the baton in place, this allows Pointed Tip 8 to stay covered (FIG. 1), and cannot accidently scratch user. This system will allow said user to, for example extricate willing or unwilling people involved in a crime or automobile accident, from automobiles.

Figure 8:
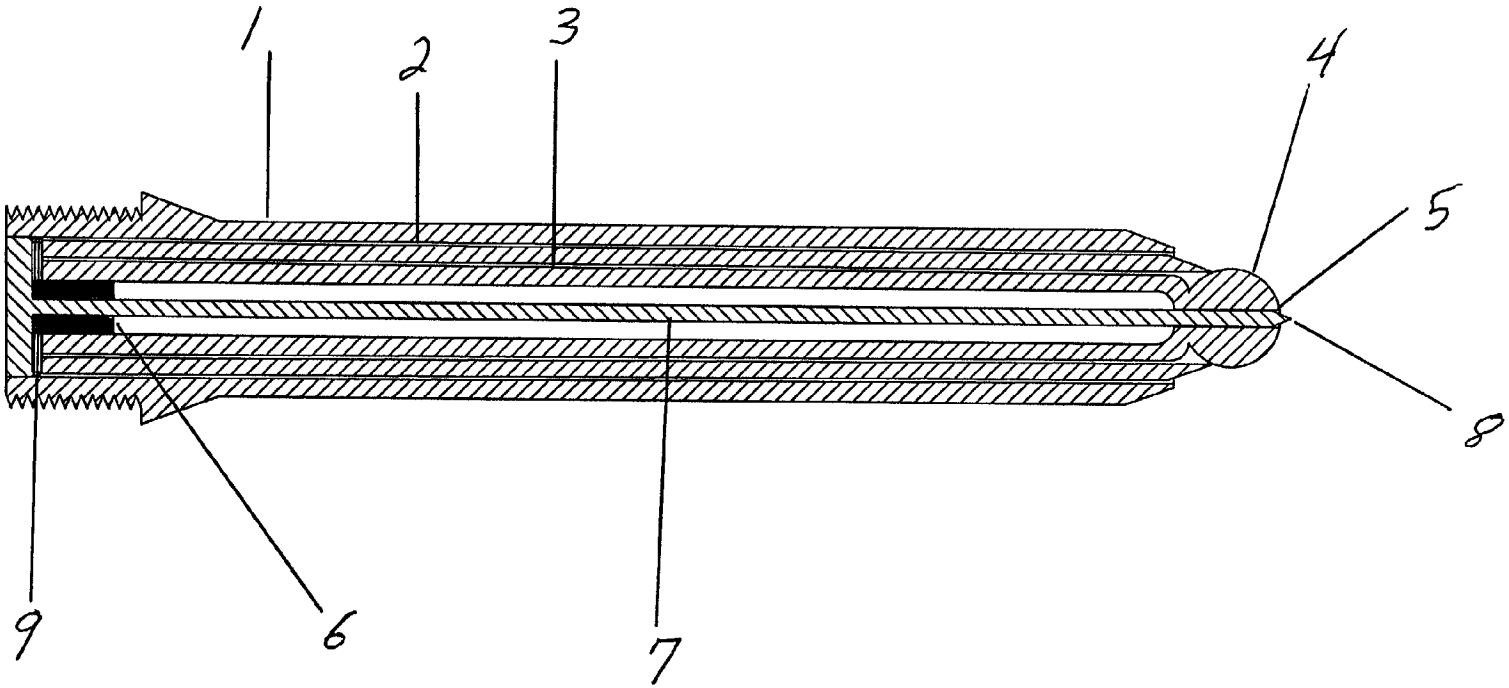
FIG. 8 Depicts cross section view of protruded compact glass breaking tip.

In this first embodiment Handle Unit 102 of FIG. 11 is comprised of an Exterior Shell 10 and Handle 11. Orthogonal Baton Handle 11 preferably extends integrally from Exterior Shell 10 wherein the Handle 11, Tapers 12, opposite Exterior Shell slightly outward to keep the baton in the users hand while swinging the Baton of FIG. 2, from side to side. The Handle Top 13 is shaped in a domelike manner for ease of switch operations (discussed below). Handle 11 extends perpendicularly and smoothly from Exterior Shell 10, which is preferably round at its proximal end and tapers down just past Handle 11. Exterior Shell 10 of FIG. 11's taper contains Internal Threading 14 connection at its distal end. Telescoping Tubular Member 1 of FIG. 2 has Interchangeable Threads 15 that fit into Internal Treading 14. The baton portion may be disconnected manually (FIG. 8).

Exterior Shell 10 of FIG. 11 has 2 Quick Change Holes 16 near its proximal end, that allows user to access Release Tabs 17 to assist removing Lens Cover Unit 18 by using 2 fingers depressing release tabs simultaneously and pulling Lens Cover Unit 18 towards its proximal end. Once removed the user may change the Light Bulb 19 or Battery Pack 21 very quickly. The Exterior Shell 10 contains an Access Port 22 opposite of Handle Top 13 in FIG. 11.

Access Port 22 of FIG. 1 accepts Deterrent Spray Canister 23. Deterrent Spray Canister 23 is pushed through Access Port 22 through Hollow Handle 11 internally until Canister Plug 24 a threaded bottom affixed to Deterrent Spray Canister 23 begins to advance upward screwing into Access Port 22 of Exterior Shell 10. When screwed into place canister Stem 37 will enter Deterrent Spray Canister Valve 30, threaded Plug 24 will keep Access Port 22 watertight. The Deterrent Spray Canister 23 and Canister Plug 24 are designed as a 1 piece Disposable Unit.

The location of Handle 11 on Exterior Shell 10 is determined from balance, weight and center of gravity considerations. Preferably Handle 11 is 40 to 45% of the distance from the proximal end of the multifunctional law enforcement tool of FIG. 1.

Handle Unit 102 of FIG. 11's Exterior Shell 10 possesses two holes for Recharging Contacts 25 wherein Battery Pack 21 may be recharged externally making Battery Pack 21's removal unnecessary. The multifunctional law enforcement tool includes a Wiring Harness 38 located inside Exterior Shell 10 and travels through orthogonal Handle 11 alongside Deterrent Spray Canister 23 and connects to Stun Gun Rocker Switch 26 and Flashlight Switch 27 (discussed below). The wiring and other mechanisms connect the Battery Pack 21, Flashlight Switch 27, Recharge Contacts 25, Bulb Holder Unit 20 and Stun Gun Switch 26. Two screws hold rechargeable Contact 25 and Wiring Harness 38 in place.

Figure 6:
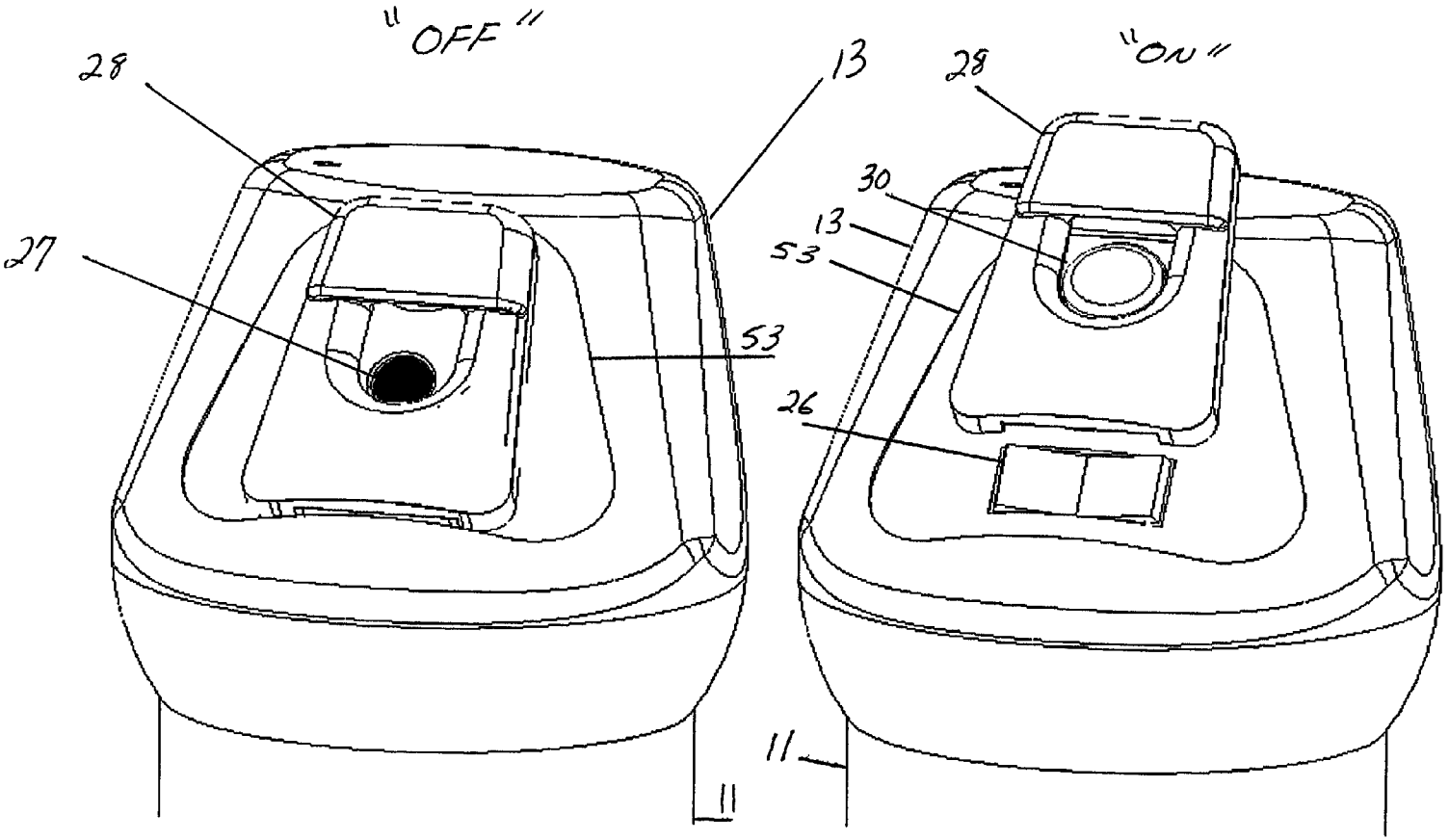
FIG. 6 Depicts a perspective view of light switch in "on" and "off" positions. The "on" position exposing spray valve, stun gun and flashlight mechanisms.
Figure 9:
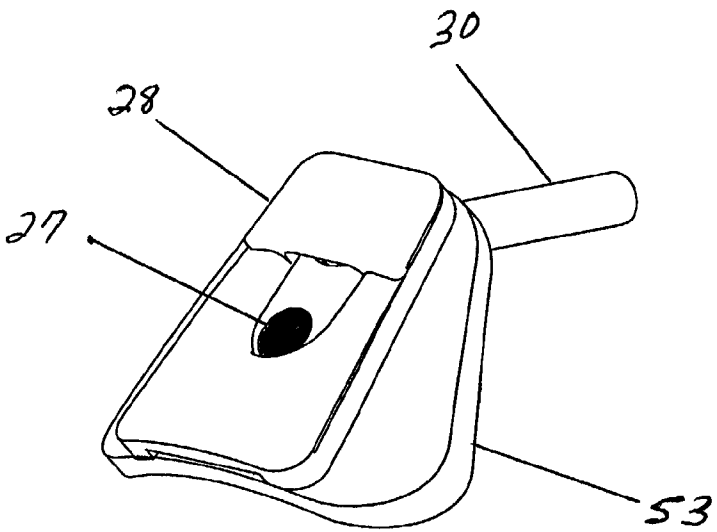
FIG. 9 Depicts handle top faceplate with flashlight and stun gun switches with deterrent spray valve in cross section and perspective views.
Figure 9:
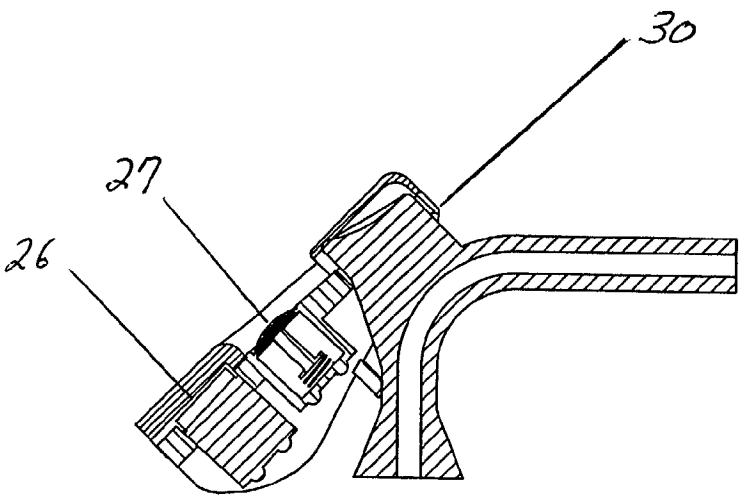
Figure 10:
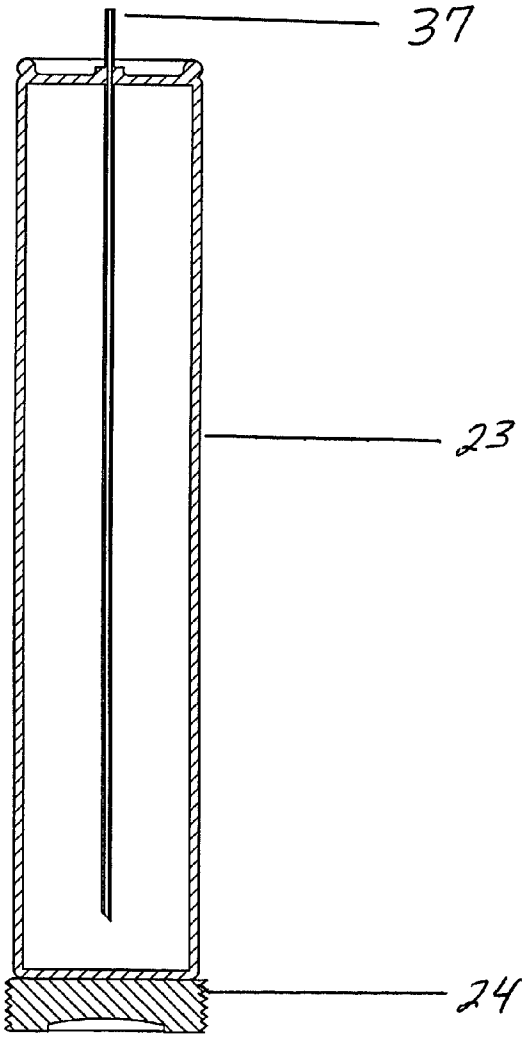
FIG. 10 Depicts cross section view of deterrent spray canister.
Figure 12:
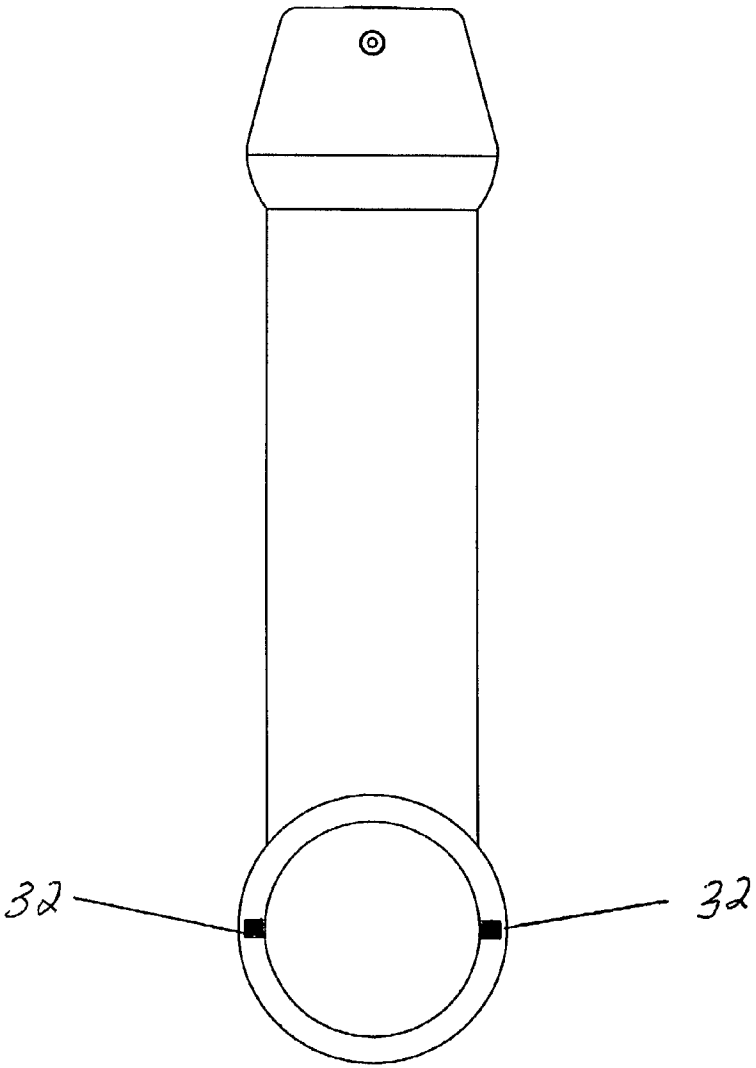
FIG. 12 Depicts a perspective view of stun gun probes.

The user will preferably operate the Flashlight Switch 27 and Stun Gun Switch 26 of FIG. 6 located on Handle Top 13 facing its distal end with his or her thumb while holding Handle 11 with four fingers wrapped around said Handle 11. This will allow the underside of users forearm to block any potential strikes from combatant using the multifunctional law enforcement tool as a shield The Slide Switch 28 acts as a safety covering the Stun Gun Switch 26 and Deterrent Spray Canister Valve 30 making them inaccessible to user while insuring against accidental firing or discharge. When the Slide Switch 28 of FIG. 6 is covering the switches, it is in the down or "off" position. The operator may push the Slide Switch 28 upwards or in the direction of the Handle Top 13, this compresses Flashlight Switch 27 turning on the light while simultaneously lining up the holes in the Slide Switch 28 with the Spray Canister Valve 30, making accessible Deterrent Spray Valve 30. The Stun Gun Switch 26 is also accessible at this point. The user may access either switch or valve immediately. The users thumb pushes down on Spray Canister Valve 30 discharging deterrent spray in the direction of the illuminated flashlight or the proximal end. By accessing the Stun Gun Switch 26, a Rocker Switch side to side the user will discharge a high voltage arc visible at proximal end between Metal Probes 32 of FIG. 12, on inner lens bevel. By simply touching the attacker with Metal Probes 32, the user may disable attacker with as much but not limited to 400,000 volts. The user may activate safety or Slide Switch 28 of FIG. 6 in a downward manner thus turning "off" the flashlight and covering the Stun Gun Switch 26 and Canister Spray Valve 30. When Slide Switch 28 is in said "off" position the user may still access the Flashlight Switch 27. By pushing down with his or her thumb on the Flashlight Switch 27 intermittent use is attainable without uncovering switches. FIG. 9's Flashlight Switch 27, Stun Gun Switch 26 and Deterrent Spray Canister Valve 30 are mounted in a Faceplate 53 which is attached by screws to the Handle Top 13 facing the distal end of the Baton.

The Handle Unit of FIG. 11, Exterior Shell 10 houses three separate components longitudinally that are electrically connected. A Battery Pack 21 furthest Inside Exterior Shell 10 which is connected to the Bulb Holder Unit 20 located between and connected to the Lens Cover Unit 18 located at the proximal end of Exterior Shell 10. The Battery Pack 21 may be recharged by a battery charger unit placed against the Exterior Shell 10, while touching Recharge Contacts 25.

Figure 3:
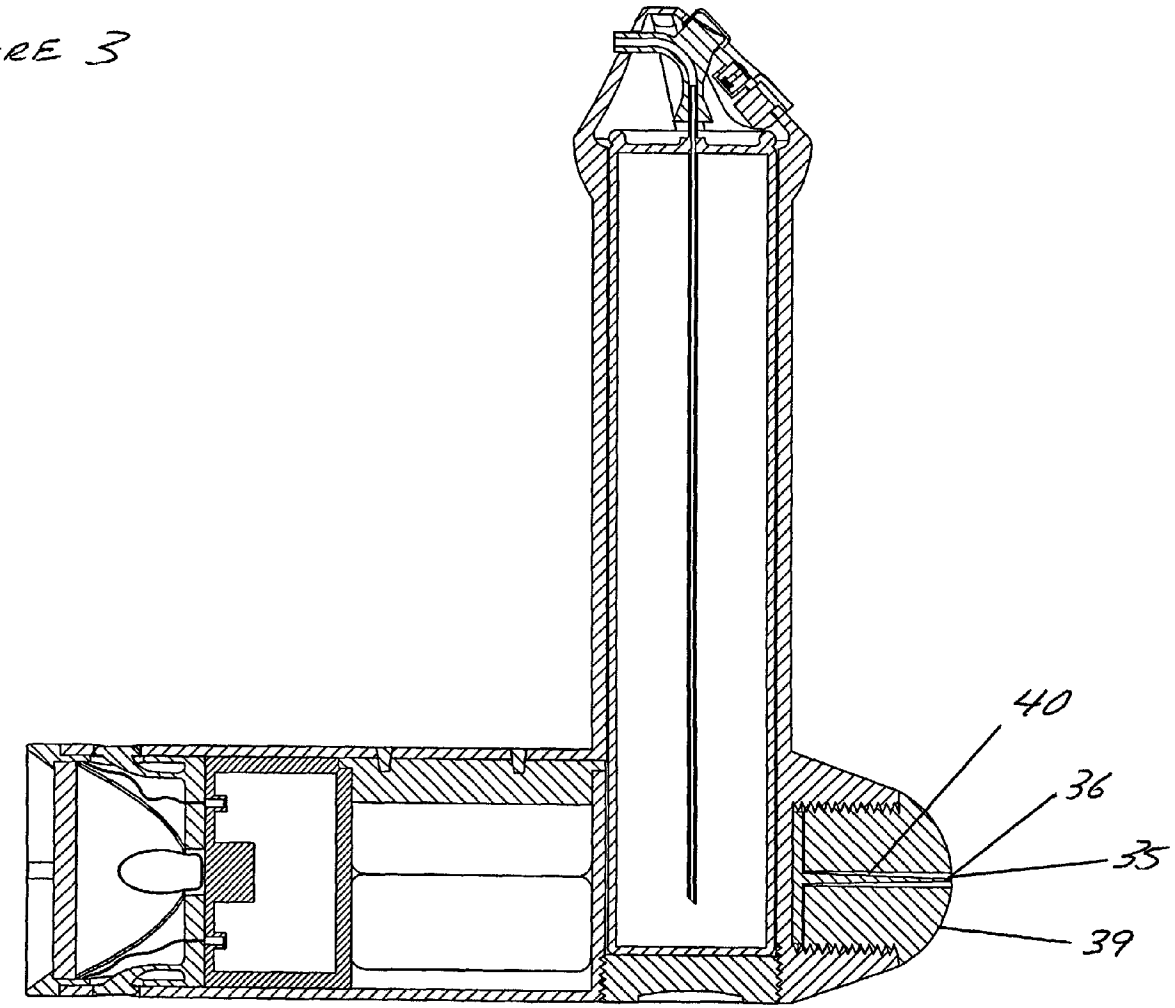
FIG. 3 Depicts the embodiment of FIG. 1 without extendable baton and glass breaker and with rubber compression unit and miniature glass breaker.
Figure 4:
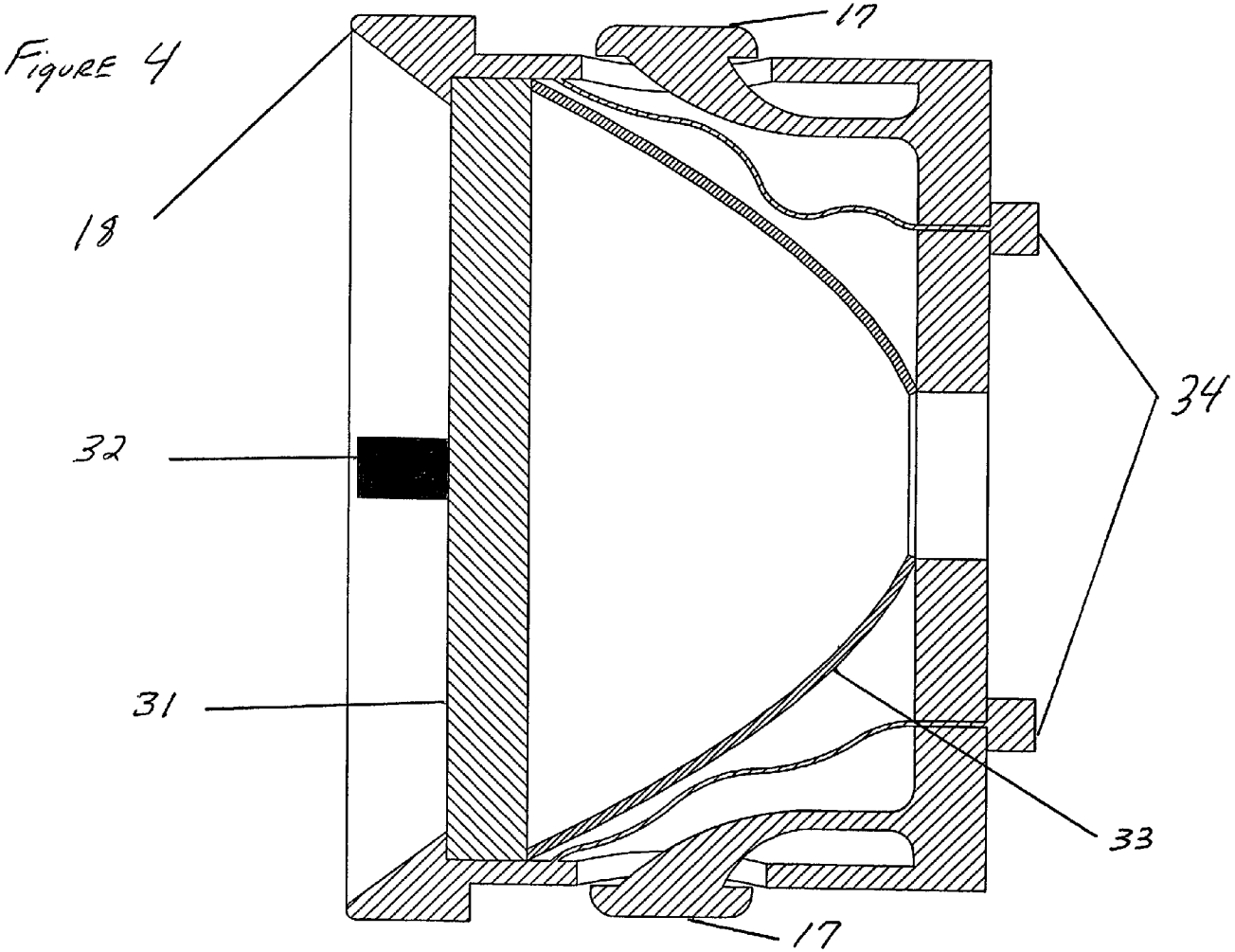
FIG. 4 Depicts a cross section view of flashlight lens cover unit with reflector and stun gun probes.

The Handle Unit of FIG. 3's, Exterior Shell 10 houses a Lens Cover Unit 18 of FIG. 4, wherein it may include a Shatterproof Lens 31, Parabolic Reflector 33, Release Tabs 17, Backside Contacts 34 and Metal Probes 32. The Lens Cover Unit 18 maintains its position inside the Exterior Shell by two Release Tabs 17 that line up with Quick Change Holes 16 when inserted in the proximal end Shell 10 and pushes towards its distal end. The release tabs will expand outwardly into Quick Change Hole 16 locking Lens Cover Unit 18 into Exterior Shell 10, wherein Backside Contacts 34 complete electrical connection with Bulb Holder Unit 20's Frontal Connections 42.

Figure 7:
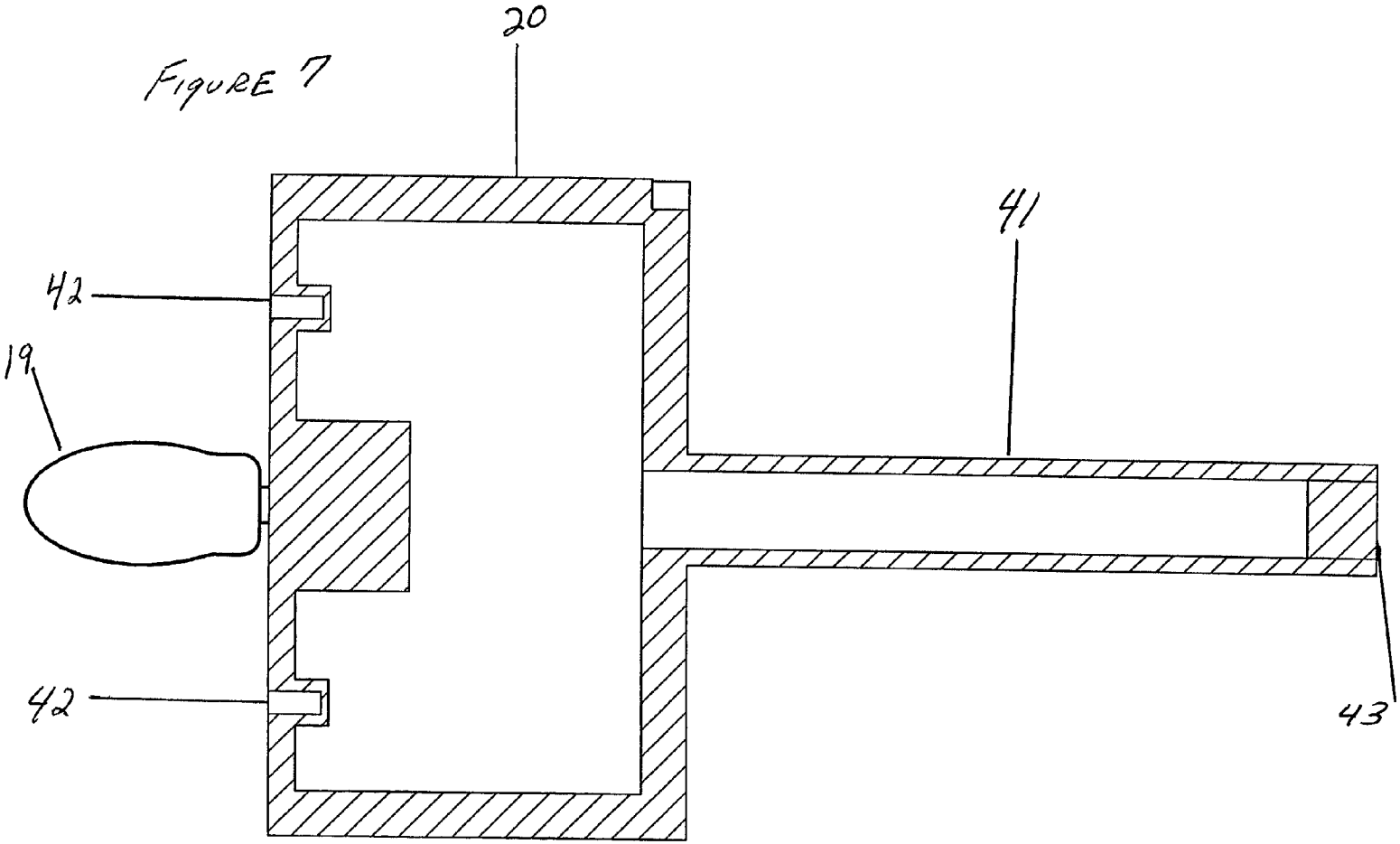
FIG. 7 Depicts a perspective view of bulb housing unit with stun gun and flashlight mechanisms and battery pack holder.

Bulb Holder Unit 20 of FIG. 7 may contain buy not limited to a Flashlight Bulb 19, Two Frontal Contacts 42, Battery Holder 41, Battery Plug In Contact 43, with all stun guns and flashlight electrical components, housed internally. The Battery Holder 41 preferably slides longitudinally through the open space created between multiple cells in the Battery Pack 21, to its furthest point forward. Battery Pack 21 will electrically engage or contact with Battery Plug In Contact 43. Bringing power to Bulb Holder Unit 20.

FIG. 3 depicts a second embodiment of the multifunctional law enforcement tool without the baton and glass breaking unit (FIG. 11). The handle unit of FIG. 1 remains entirely unchanged.

In the second embodiment, however, FIG. 3 depicts the multifunctional law enforcement tool with a Miniature Glass Breaker 40 may be installed with a Rubber Compression Unit 39 (FIG. 3), and struck against Rubber Hole 35 allowing Miniature Glass Breaker 40's Tip 36 to penetrate glass. Rubber Compression Unit 39 will return to its original shape covering Glass Breaker Tip 36. This smaller profile unit will allow undercover law enforcement and possibly airline security personnel to carry the Handle Unit 102 of FIG. 3 without detection.

The multifunctional law enforcement tool of the first embodiment comprises a flashlight, stun gun, glass breaker, deterrent spray and an extendable baton.

Figure 13:
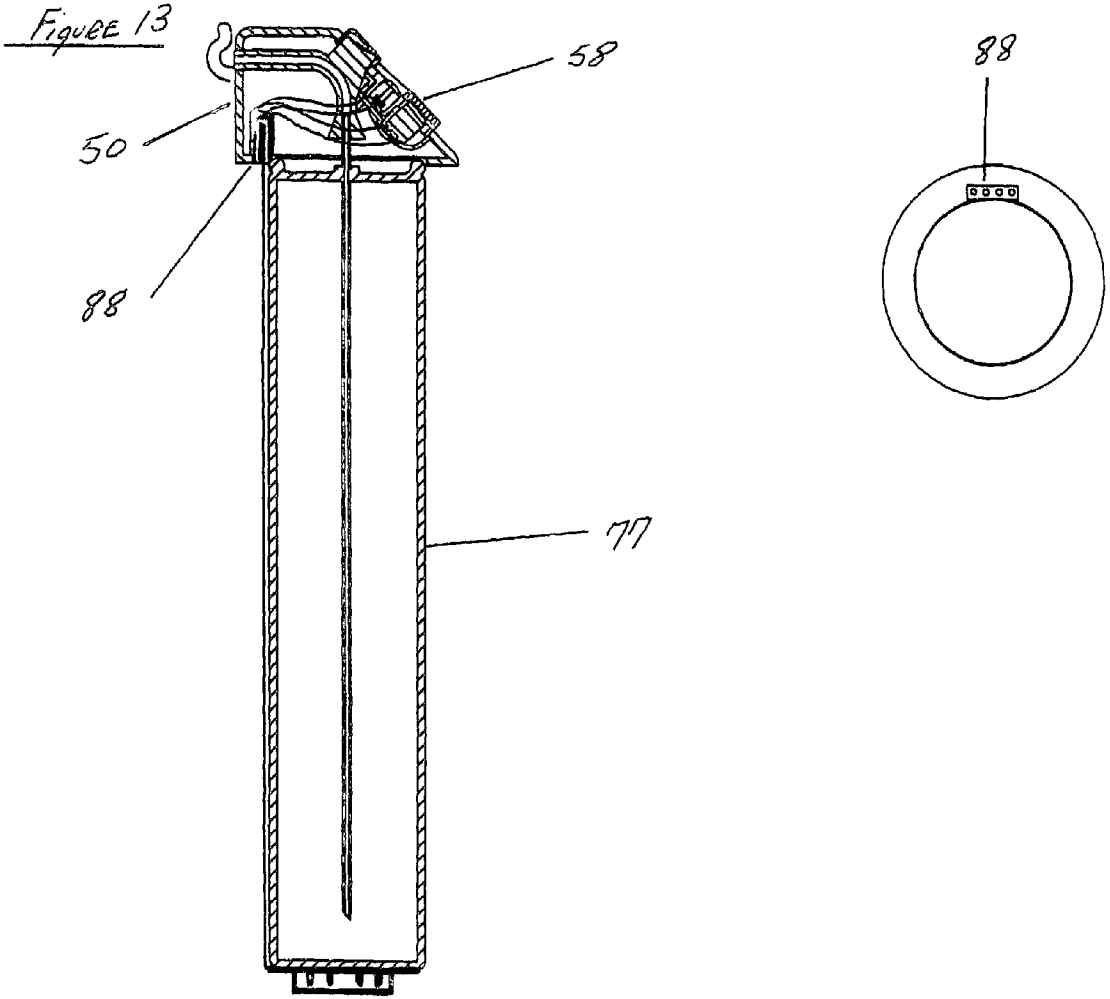
FIG. 13 Depicts a sectional view of the canister with housing.
Figure 14:
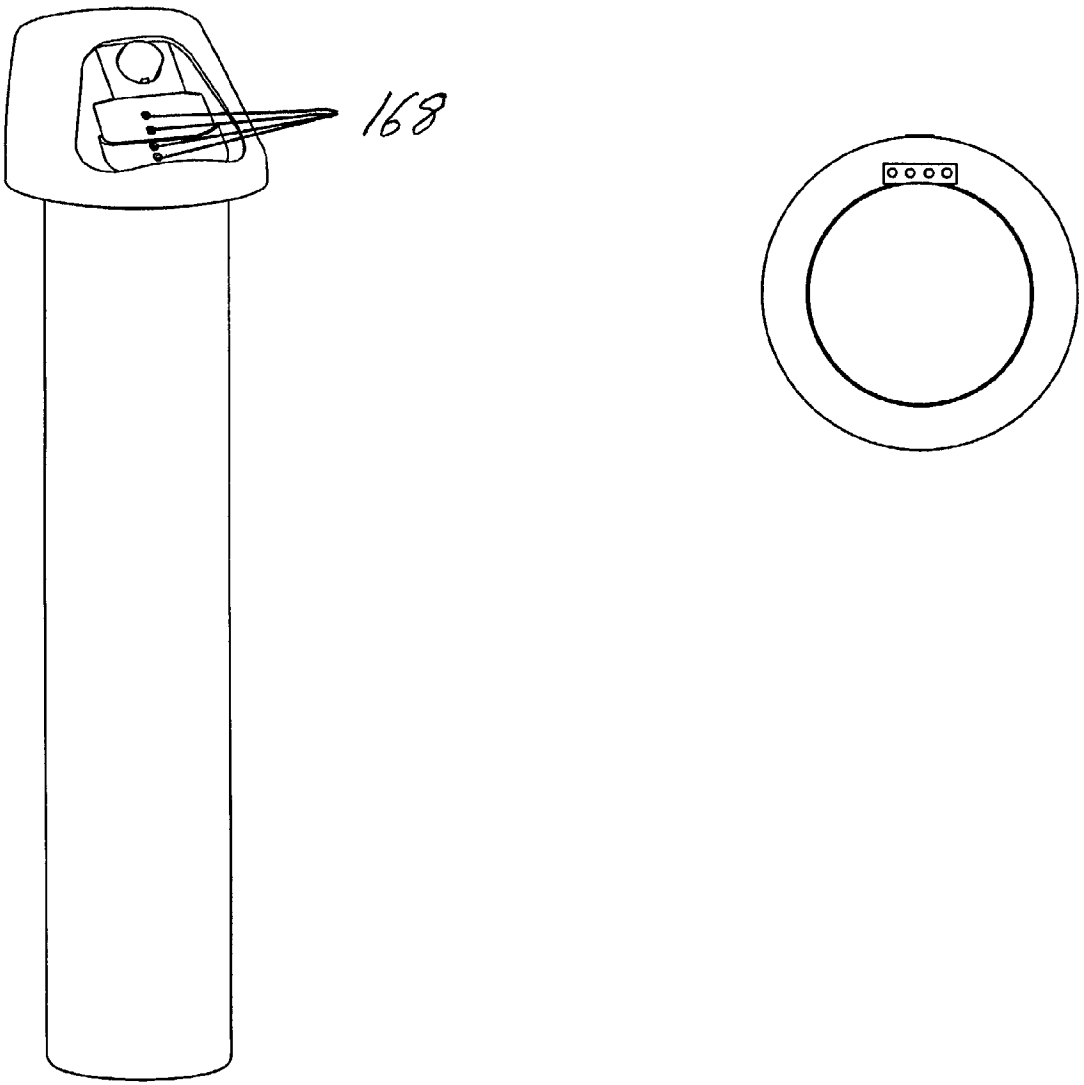
FIG. 14 Depicts a perspective view of canister housing.
Figure 15:
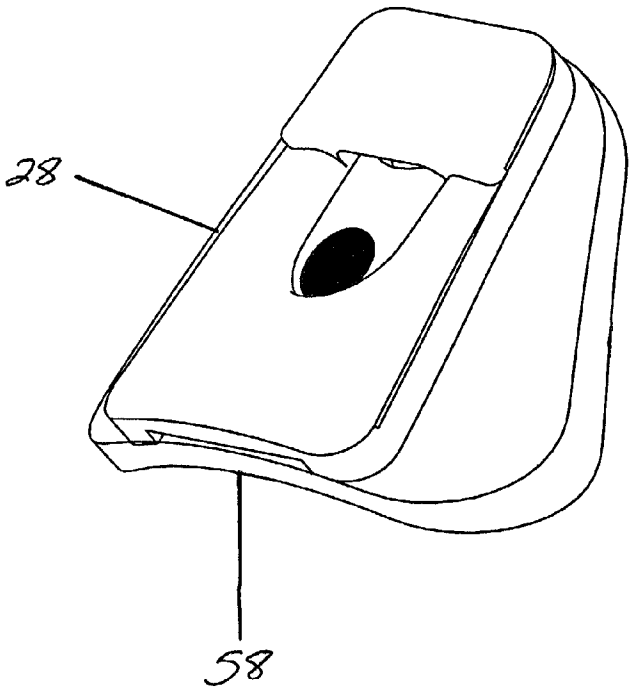
FIG. 15 Depicts a perceptive and cross section view of removable faceplate.
Figure 15:
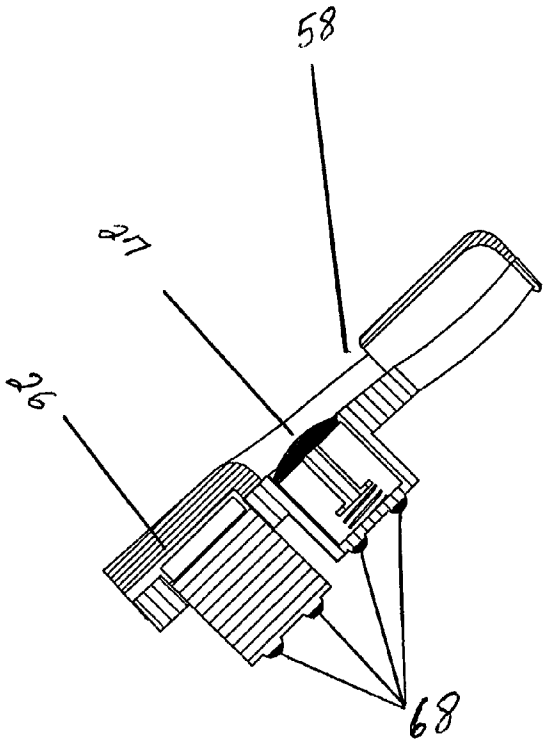

In the third embodiment the multifunctional law enforcement tool has no functional change, however the Handle Top 13 of FIG. 1, which is an integral part of the Handle Unit (FIG. 11) of the first embodiment, is removable in the third embodiment. Removable Handle Top 50 of FIG. 13 is attached to Deterrent Spray Canister 77 and is a one piece disposable unit. The threaded Plug 24 is no longer attached to canister but still remains threaded into handle unit. The Stun Gun Switch 26, Flashlight Switch 27, and Slide Switch 28 of FIG. 9 of the first embodiment are attached to Faceplate 53 and screwed into Handle Top 13. In the third embodiment Stun Gun Switch 26, Flashlight Switch 27 and Slide Switch 28 are attached to Faceplate 58 (FIG. 15), which plugs into Spray Canister 77's removable Handle Top 50 which contains a Socket 168 (FIG. 14) and Socket 88 (FIG. 13). The handle top or housing with Socket 88 and 168 is a one piece diposable unit with wiring and contacts being an integral part of the Handle Top 50. When the user is finished with the Spray Canister 77 and its Handle Top 50, he or she will unplug Faceplate 58 (FIG. 15) and plug it into a full or new unit. Multiple Contacts in Socket 168 which is on Handle Top 50 (FIG. 14), connect with contacts on the Faceplate 58 and complete the circuit making Flashlight Switch 27, and Stun Gun 26 operational.

I claim:

1. A multifunctional law enforcement tool comprising:

a handle unit comprising an elongated member on a longitudinal axis and a handle generally orthogonally to the longitudinal axis, wherein the handle comprises a deterrent spray mechanism, and wherein said elongated member houses a flashlight and stun gun mechanisms at one end opposite an interchangeably connectable external baton housing longitudinally, wherein a telescoping tubular baton is slidably connected to the baton housing to a compact first position substantially inside the baton housing and an extended second position extending therefrom, wherein said baton houses a glass breaking mechanism wherein a pointed member with a pointed tip protrudes through a hole in baton tip in said compact first position.

2. a multifunctional law enforcement tool of claim 1, wherein the pointed member has a pointed tip and wherein the extendable baton has a hole and slides relative to the pointed member to slide from said position to a third position farther inside the housing than the first position, wherein a spring returns the baton to said first position wherein a magnetized mechanism keeps the baton in said first position.

3. A multifunctional law enforcement tool comprising:

a handle unit comprising an elongated member on a longitudinal axis and a handle generally orthogonally to the longitudinal axis, wherein the handle comprises a deterrent spray mechanism, and wherein said elongated member houses a flashlight and stun gun mechanisms at one end opposite an interchangeably connectable glass breaking mechanism wherein a pointed member with a pointed tip protrudes through a hole in a compressible housing.

4. The multifunctional law enforcement tool of claim 3, wherein a cylindrical housing contains the means for an exposed electrical current to arc across a flashlight lens wherein a parabolic reflector is located, inside of said housing.

5. A multifunctional law enforcement tool comprising:

a flashlight switch that is moveable to a position comprising a first position which is adapted to turn on a flashlight and to reveal a spray valve mechanism and a stun gun switch, and a second position, which is adapted to turn off the flashlight and to cover the spray valve mechanism and the stun gun switch, wherein a cutout in said cover permits user accessibility to flash light switch in said second position.

6. A multifunctional law enforcement tool comprising:

a handle unit for detachable connection to an extendable baton, the handle unit comprising a detachable connection mechanism for connecting extendable baton opposite a stun gun and flashlight mechanisms wherein an orthogonal handle houses a deterrent spray canister, spray valve mechanism and slidable switch moveable to a first position which is adapted to turn on a flashlight and to reveal the spray valve mechanism and the stun switch and a second position which is adapted to turn off a flashlight and cover the spray valve mechanism and stun gun switch.

* * * * *